US006732839B2

(12) United States Patent
Schuster

(10) Patent No.: US 6,732,839 B2
(45) Date of Patent: May 11, 2004

(54) CONTACTLESS SWITCHING DEVICE FOR AN ELEVATOR SAFETY CHAIN

(75) Inventor: Kilian Schuster, Ballwil (CH)

(73) Assignee: Inventio AG, Hergiswil (CH)

( * ) Notice: Subject to any disclaimer, the term of this patent is extended or adjusted under 35 U.S.C. 154(b) by 0 days.

(21) Appl. No.: 10/353,648

(22) Filed: Jan. 29, 2003

(65) Prior Publication Data

US 2003/0111300 A1 Jun. 19, 2003

Related U.S. Application Data

(63) Continuation of application No. PCT/CH01/00474, filed on Feb. 8, 2001.

(30) Foreign Application Priority Data

Aug. 7, 2000 (EP) ..... 00810706

(51) Int. Cl.[7] ..... B66B 1/34; B66B 3/00
(52) U.S. Cl. ..... 187/391; 187/316; 187/247
(58) Field of Search ..... 187/247, 277, 187/280, 390–392, 316, 317; 382/103, 325

(56) References Cited

U.S. PATENT DOCUMENTS

| | | | | |
|---|---|---|---|---|
| 3,054,475 A | | 9/1962 | Moser et al. | |
| 5,103,222 A | * | 4/1992 | Hogen Esch et al. | 340/825.34 |
| 5,300,875 A | | 4/1994 | Tuttle | |
| 5,487,448 A | * | 1/1996 | Schollkopf et al. | 187/247 |
| 5,708,416 A | * | 1/1998 | Zaharia et al. | 340/531 |
| 6,173,814 B1 | * | 1/2001 | Herkel et al. | 187/288 |
| 6,408,986 B1 | * | 6/2002 | Ayano et al. | 187/290 |
| 6,446,761 B1 | * | 9/2002 | Motoyama et al. | 187/391 |
| 6,550,585 B2 | * | 4/2003 | Schoppa et al. | 187/391 |
| 2003/0047390 A1 | * | 3/2003 | Crenella et al. | 187/395 |
| 2003/0089558 A1 | * | 5/2003 | Zepke et al. | 187/413 |

FOREIGN PATENT DOCUMENTS

| | | |
|---|---|---|
| DE | 197 37 464 | 3/1999 |
| EP | 0 535 205 | 4/1993 |
| EP | 0 757 011 | 2/1997 |
| WO | WO 92/18410 | 10/1992 |
| WO | WO 98/48523 | 10/1998 |

* cited by examiner

*Primary Examiner*—Jonathan Salata
(74) *Attorney, Agent, or Firm*—MacMillan Sobanski & Todd, LLC

(57) ABSTRACT

A monitoring device for an elevator includes a plurality of switching devices connected in a series safety chain. Each switching device has an active unit generating a pattern and a passive unit that responds to the pattern within a defined spacing between the units.

13 Claims, 4 Drawing Sheets

CONTACTLESS SWITCHING DEVICE FOR AN ELEVATOR SAFETY CHAIN

This is a continuation of Application No. PCT/CH01/00474, filed Feb. 8, 2001.

BACKGROUND OF THE INVENTION

The present invention relates to a monitoring device for an elevator, which device includes at least one contactlessly actuatable switching device.

In elevator installations, individual actions, for example travel of an elevator, are in general monitored with the assistance of switching devices. Several such switching devices must have a specific state in order to be able to undertake the proposed action. In particular, in the case of an elevator installation it must be ensured that before the start and during the travel of the elevator car all doors remain closed and mechanically locked.

There is known from the European patent document EP 0 535 205 B1 a monitoring device for a control device which comprises a safety chain and which is provided with a switching device comprising a sensor and able to be triggered in contactless manner. The switches or sensors are actuated by approach or movement away of a magnet.

The fact that the switch or the sensor reacts to each magnet independently of whether this magnet is the correct magnet intended for the selected switch or sensor is disadvantageous in this solution. The approach of an appropriate material is sufficient to trigger a valid signal. As soon as the switch is disposed in the working range of the magnet, it triggers a valid signal. A faulty function (false triggering) of the switch or the sensor can hardly be excluded without considerable cost. Erroneous triggering can also be caused by, for example, articles and/or external interferences, which put at risk the safe operation of the elevator installation.

SUMMARY OF THE INVENTION

The present invention has the object of proposing a monitoring device for a elevator of the kind stated in the introduction, which does not have the aforesaid disadvantages and which enables reliable monitoring free of disturbance. Moreover, the monitoring device is insensitive with respect to articles and external manipulations. The components to be monitored are unambiguously identifiable by means of the monitoring device.

One advantage is that a valid signal can be triggered only by, for example, a globally unique passive unit. The active unit cannot generate a valid signal without having the correct passive unit in range. A further advantage consists in that the monitoring is guaranteed by elements able to be produced economically.

A further advantage is that several switching devices can be monitored simultaneously with respect to functional capability and state. The interlinking of several active units takes place in the manner that the responses of all passive units are so linked that a mutual influencing in the sense of a false interpretation can be excluded.

The fact that a data exchange between active and passive unit can take place only through proximity of the coils operating as antennae is of further advantage.

Moreover, it is advantageous that the passive unit does not need an energy supply or battery. This is achieved by the fact that it comprises an energy store in which the energy transmitted by the active unit can be stored. Energy is thus saved. As the energy for generation of the response has to be transferred, spontaneous activity is not possible.

All explained features are usable not only in the respectively stated combination, but also in other combinations or by themselves without departing from the scope of the invention.

DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

Figure 1:
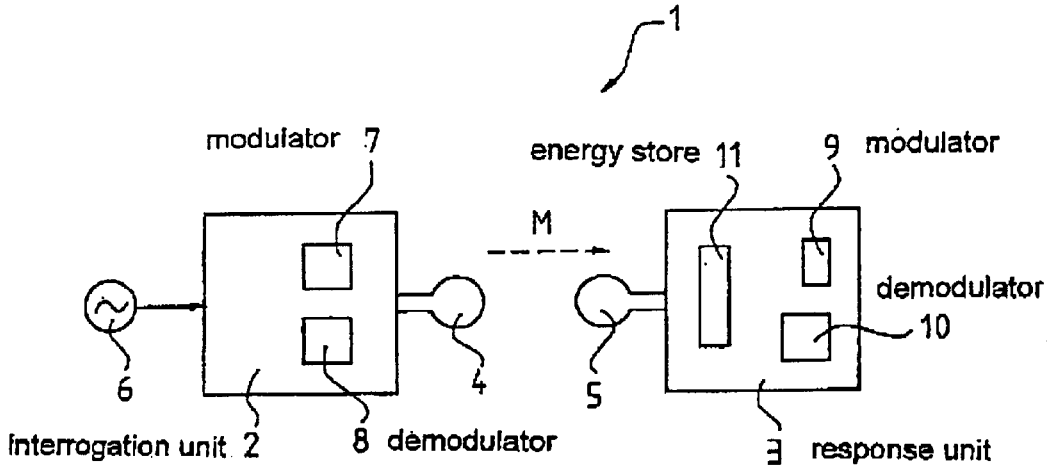
FIG. 1 is a schematic block diagram of a switching device in a safety chain in a rest state, i.e. in the ineffective state, in accordance with the present invention.

In FIG. 1 there is illustrated a switching device 1 of an electronic safety chain, wherein the switching device 1 is an active unit constructed as an interrogation unit 2 and a passive unit constructed as a response unit 3. The response unit 3 can be, for example, a transponder, a tag, a smart card or a chip card. The interrogation unit 2 includes a first coil 4 and the response unit 3 includes a second coil 5. The interrogation unit 2 and the response unit 3 are disposed in a so-called rest state, i.e. are spaced from one another by such a distance that no interaction, thus no electromagnetic coupling, takes place therebetween. The interrogation unit 2 generates a pattern M, which is transmitted to the response unit 3 and to which the response unit 3 does not react.

Figure 2:
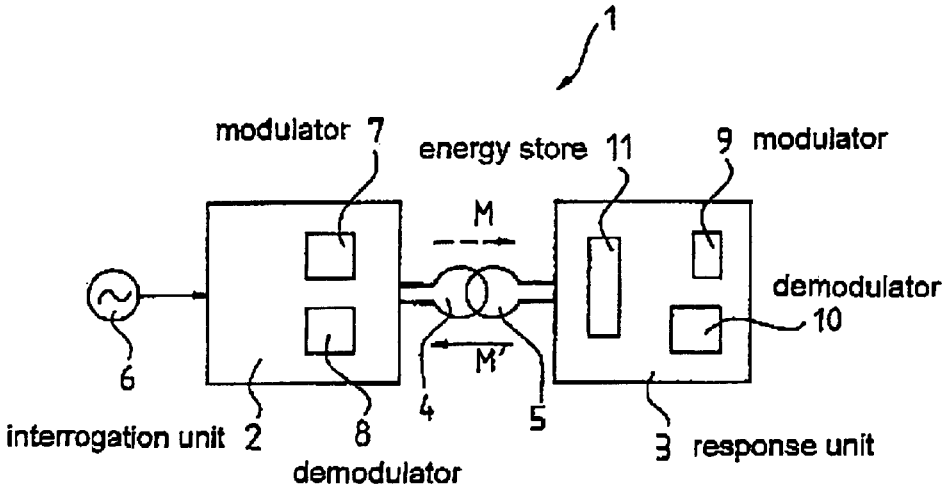
FIG. 2 shows the switching device of FIG. 1 in the operational state, i.e. in the effective state.

In FIG. 2 there is shown the same switching unit 1 of FIG. 1, but in this case, in a so-called operational state. The interrogation unit 2 and the response unit 3 are arranged so close to one another that an interaction takes place. Thus, an electromagnetic coupling between the interrogation unit 2 and the response unit 3 occurs. To the pattern M generated by the interrogation unit 2 there is given on the part of the response unit 3 a complex response M'.

In one embodiment, the interrogation unit 2 can include a generator 6, a first modulator 7 and a first demodulator 8. The generator 6 can be, for example, a HF generator, a RF generator and so forth. The response unit 3 can in turn include a second modulator 9 and a second demodulator 10. The response unit 3 can further include an energy store 11 that can be constructed as, for example, a capacitor with a capacitance. The response unit 3 thus preferably does not possess an energy supply or battery.

The essential principle of function of the system consisting of the interrogation unit 2 and response unit 3 is described in more detail in the following in a preferred embodiment.

The interrogation unit 2 is so constructed that it is in a position to transfer data to the response unit 3 and/or receive data from the response unit 3. The first coil 4 and the second coil 5 are, in this example, constructed as antennae. The interrogation unit 2 transmits the energy to the response unit 3 by way of an electromagnetic field. Reference is made to electromagnetic coupling, as the energy transmission functions similarly to that in a transformer, where the energy is transferred from the primary winding to the secondary winding by way of close coupling. The energy coupled by way of the electromagnetic field is temporarily stored by the response unit 3 in the energy store 11. As soon as the response unit 3 has received sufficient energy, it is functionally capable and responds in very specific mode and manner to the pattern M generated by the interrogation unit 2.

The pattern M and/or the response M' can be, for example, numbers which are represented by a bit pattern/bit sequence. The pattern M exciting the response unit 3 does not need to be very complex, as it primarily serves for the transmission of energy and triggering the response M'. In one embodiment, the pattern M can possibly be a HF carrier and be generated as a phase-modulated signal. The pattern M is used by the response unit 3 merely for obtaining energy and synchronization of a response. In other words, the pattern M can be understood as an instruction to the response unit 3 to generate the corresponding response M'.

In this manner a causal linking of response and interrogation is ensured.

The pattern M does not need to be constant and can be predetermined by the interrogation unit 2 or from an external source.

However, a data exchange according to a classic modulation method (amplitude modulation AM, frequency modulation FM, etc.) between the interrogation unit 2 and the response unit 3 could also take place.

The response unit 3 changes the pattern M in such a manner that it is ensured that this change is carried out by the corresponding response unit 3 alone and not by another element. This can be effected, for example, in that the response unit 3 responds to an interrogation by the transmission of an unambiguous number. Thus, the response unit 3 is unambiguously identified.

Figure 3:
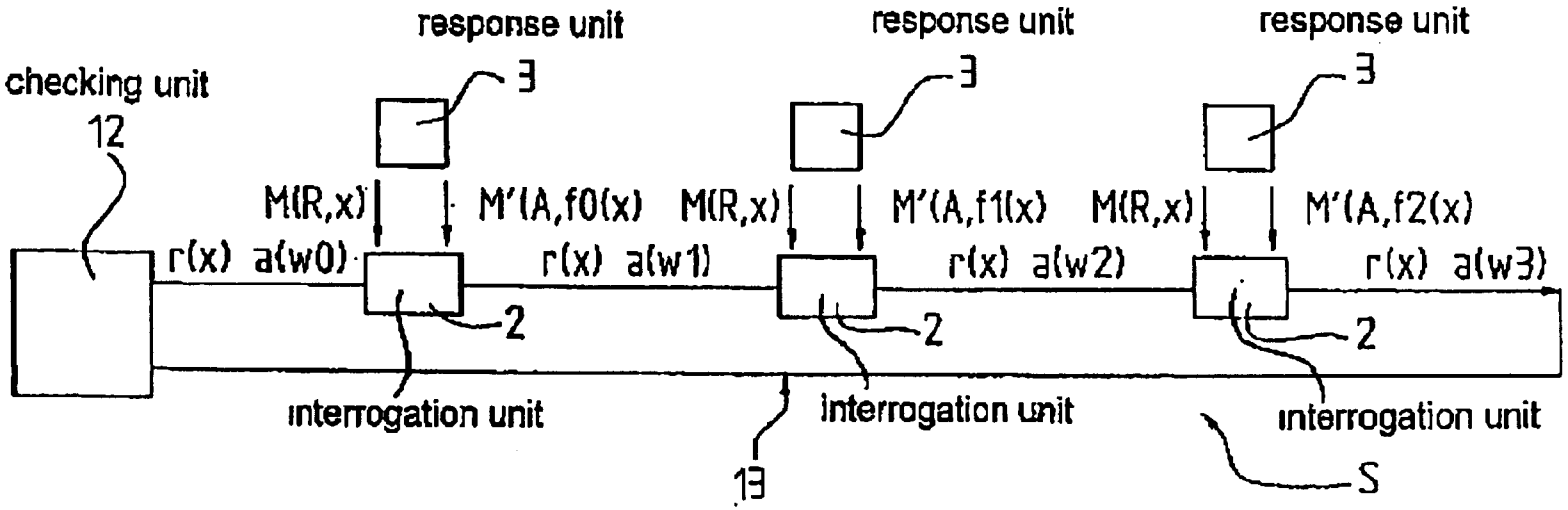
FIG. 3 is a schematic diagram of an interlinking of several the switching devices.

FIG. 3 shows an interlinking of several of the switching devices 1, which are linked in series with a central checking unit 12. The central checking unit 12 transmits a command r(x) and an instruction a(w) in data word format by way of a serial channel 13 to all interrogation units 2 of the safety chain S. An electromagnetic signal is generated therefrom and transmitted as the pattern M, which can be represented by, for example, the function M(R,x), to the response units 3. The pattern M excites the respective response units 3 for the case that these are in the range or in the effective vicinity of the interrogation units 2. Each response unit 3 has a characteristic function fi(x), wherein "i" represents the participant number, thus in this example the response units 3 are denoted by the characteristic functions f0(x), f1(x) and f2(x). The response units 3 process the pattern M with the respective characteristic functions fi(x). The respective responses M', which are formed as electromagnetic data and which can, for example, be represented by the function M'(A,fi(x)), are converted into items of data word information and additively linked along the serial channel 13. The result a(w+fi(x)) is reported back to the central checking unit 12. This unit 12 checks the result for validity and thus makes a decision about the state of the safety chain S, i.e. about the state of the individual switching devices 1. The central checking unit 12 must naturally be functionally capable and reliable, which can be guaranteed, for example, by a redundant decision branch (which is not shown) in a known manner. The responses M' of the response units 3 can be additively interlinked, whereby it is ensured that the responses of all of the switching devices 1 are independent of one another. In this example this is achieved by the characteristic functions f0(x), f1(x) and f2(x).

The communication with the central checking unit 12 and the data transmission thereto can be carried out by way of, for example, the bus 13.

The characteristic function fi(x) of the response unit 3 is, for example, stored in a table. This means that the ascertaining of the function value is fed back on reading out of a store addressed by the function argument. The build-up of the table can in that case take place in a non-recurrent initialization cycle. The table contents are so selected that these are differentiated with respect to all response units. For that purpose the linear function fi(x)=ui+vi*x can possibly be used, wherein it is ensured that the image regions are each disjunctive. If subsets of response units 3 in a circle are also to be identified then the requirements must be selected to be appropriately more strict. In the general case all additive subsets must be disjunctive.

A preferred variant of embodiment results from an arrangement as illustrated in the following FIGS. 4, 5 and 6.

Figure 4:
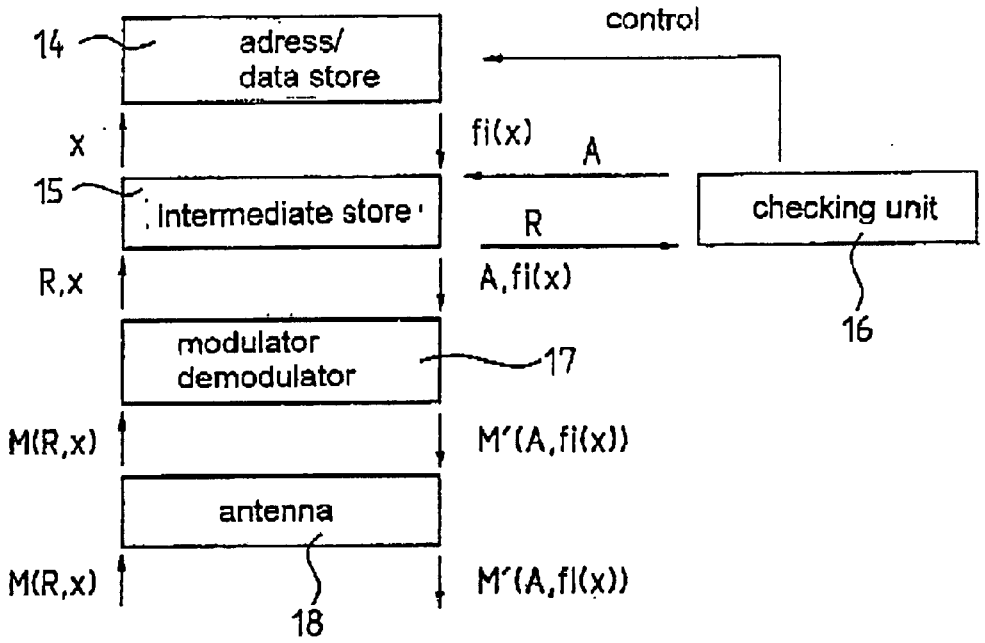
FIG. 4 shows a schematic block diagram of a passive unit according to one embodiment of the present invention.

The essential components of a response unit 3 are illustrated in FIG. 4. The response unit 3 comprises an address/data store 14, an intermediate data store 15, a local checking unit 16, a modulation/demodulation unit 17 and an antenna 18, which can be constructed as a coil. The pattern M can be represented by, for example, the function M(R,x), wherein "R" represents an interrogation and "x" an address. If a pattern M(R,x) is received by the antenna 18 and subsequently demodulated by the modulation/demodulation unit 17, then this is communicated as the interrogation "R" to the local checking unit 16. This thereupon causes reading out of the cell with the address "x" from the address/data store 14. The readout value is interpreted as the result fi(x), modulated by a code "A" and emitted by way of the antenna 18 as the response M', which can thus be represented as function M'(A,fi(x)).

The configuration of the address/data store 14, so that the contents correspond to the addresses "x" at the values f(x), can also take place by way of analog mechanisms with corresponding commands or, however, separately, for example by means of laser and constant change in the semiconductor structure.

The linking of the responses M' of several response units takes place by serial addition of the individual results along the bus 13. By means of this the interrogations of the response units 3 can also be triggered with use of appropriate commands.

Figure 5:
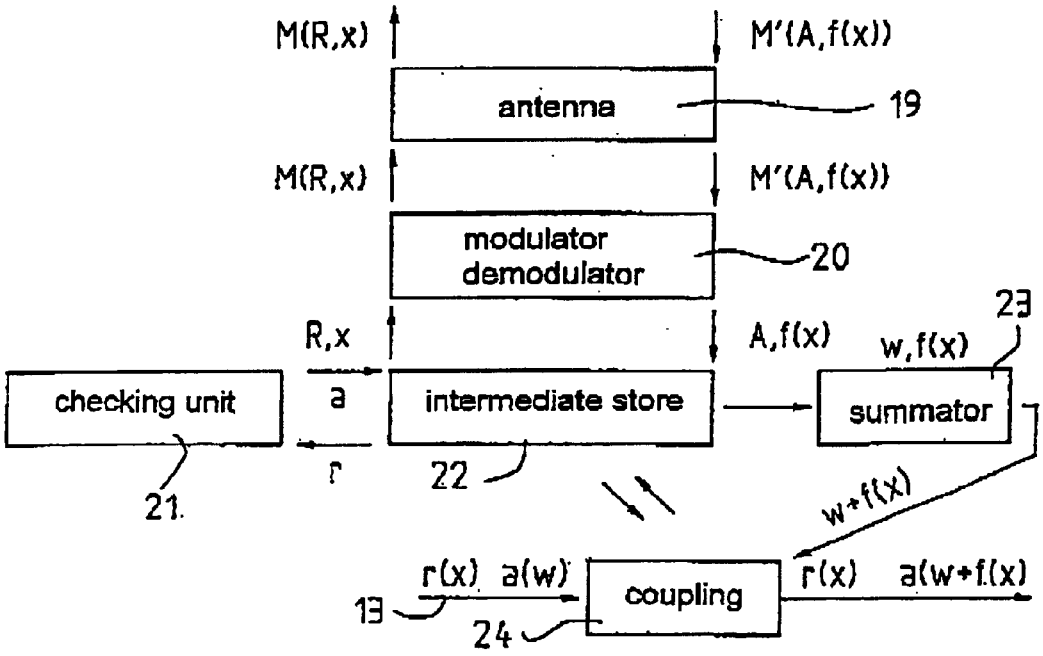
FIG. 5 is a schematic block diagram of an active unit according to one embodiment of the present invention.

The essential components of the interrogation unit 2 are illustrated in FIG. 5. The interrogation unit 2 includes a further antenna 19, a further modulation/demodulation unit 20, a further local checking unit 21, a further intermediate data store 22, a summator 23 and a bus coupling 24, which is positioned along the serial bus 13.

An interrogation command r(x), which is propagated along the bus, triggers the generation of the pattern M(R,x) in each interrogation unit. The further intermediate data store 22 is subsequently set to the value 0. All response units 3, which are disposed in sufficient proximity to the further antenna 19, thereupon respond by the response M'(A,f(x)). This is demodulated and filed, as a result, in the further intermediate data store 22. An instruction a(w) with the argument "w" is thereupon carried out by the bus 13, thus the sum w+f(x) is generated in the serial summator 23 and passed on by way of the bus coupling 24 as a(w+f(x)).

For evaluation of the outcome, the result ascertained by the summation over all tags is compared with that ascertained by the interrogation unit and in the case of agreement the safety circuit is rated as closed.

Figure 6:
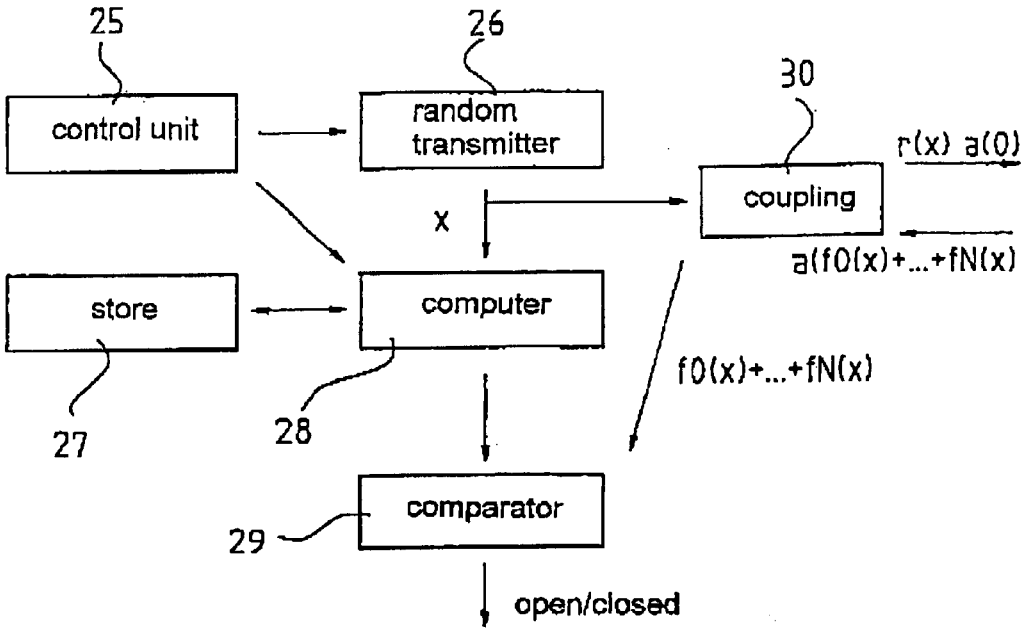
FIG. 6 is a schematic block diagram of a central checking unit according to one embodiment of the present invention.

The essential components of the central checking unit 12 are illustrated in FIG. 6. The central checking unit 12 includes a control unit 25, a random generator 26, a store 27, a computer 28, a comparator 29 and a coupling 30, which ensures the serial linking with the interrogation units 2.

For determining the state of the safety circuit, a random argument "x" is generated by the random generator 26 and transmitted to the interrogation units 2 as a command r(x). The random argument "x" will then correspond to an address of the address/data store 14 of the response unit 3. The "target value" f^0(x)+. . . +f^N(x) is simultaneously calculated by means of the data, which is filed in the store 27, concerning the function fi. In that case all response units TO . . . TN are taken into consideration which are necessary for attainment of a specific safety state. According to a well-determined time duration the interrogation of the results takes place by means of the instruction a(0). The thus-ascertained result f0(x)+. . . +fN(x) is compared in the comparator 29 with the target value and, in correspondence with the result, either the directive "circuit closed" or the directive "circuit open" is issued. A rating of the safety state can take place cyclically or on interrogation.

Other functions f(x) can also be used. Ideally, "f" is so selected that a simple criterion is usable for checking the result. In the ideal case the determination of f(x) is very difficult, where against the checking of the equation relationship w=f(x) is very simple. Functions of that kind are sufficiently known under the designation "one way function" or "trap door function" in the field of cryptography. The function does not necessarily have to deliver scalar results.

The most diverse known bus systems can be used for the communication. As the safety is guaranteed to a higher hierarchy plane, the demands on the bus system itself are very small.

The interlinking of the interrogation stations can also be managed by functions other than addition. An individual interrogation of all tags is also conceivable.

The safety demands on the components are low. Safety primarily results by the manipulation of information. It is merely necessary to ensure that the comparator operates reliably and the input signals thereof originate from independent sources (computation/bus).

With respect to the illustrated safety chain S according to FIG. 3, in which three safety devices 1 connected in series are monitored, an interrogation command r(x) which is propagated along the bus 13 by the interrogation units 2 is issued by the central checking unit 12. The interrogation command r(x) serves at each interrogation unit 2 quasi as a control command to generate a response in the response units 3. The response units 3 in the line have the characteristic functions f0(x), f1(x) and f2(x). The instruction a(w) is sent on the bus 13 by the central checking unit 12 at specific time intervals or continuously, which instruction is interpreted by the interrogation units 2 quasi as a read-out command to read the responses M' and pass them on. In the illustrated example of FIG. 3 the central checking unit 12 sends the instruction a(w0) to the first interrogation unit 2 as seen in the line, wherein w0=0 is set at the start. After the first interrogation unit 2 has received the answer M', it sends to the second interrogation unit 2 the instruction a(w1), wherein w1=a(w0+f0(x)). This procedure is repeated in corresponding manner along the bus 13 by the second and third switching devices 1 as seen in the line. After the third switching device 1, the signal a(w3) is reported back to the central checking unit 12 as the result, wherein w3=f0(x)+f1(x)+f2(x).

Figure 7:
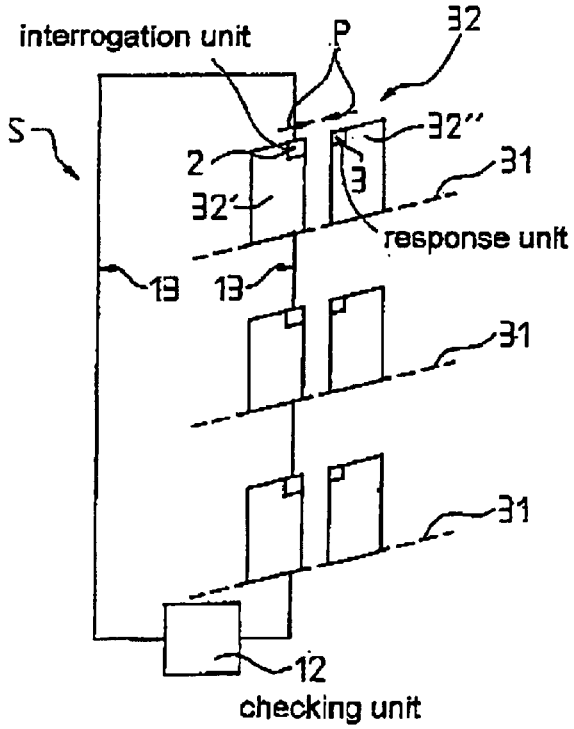
FIG. 7 is a schematic diagram of a safety chain for the door contact of an elevator installation.

The interlinking according to FIG. 3 as a safety chain for the door contacts of an elevator installation is illustrated in FIG. 7. Elevator doors 32, which in this example are constructed as shaft doors 32, are present at three stories 31 of a building. Each shaft door 32 has a first door panel 32' and a second door panel 32", which are movable relative to one another for opening and closing of the door. The closing direction of the shaft doors 32 is illustrated in FIG. 7 by the arrow P. The first door panel 32' has the interrogation unit 2 and the second door panel 32" has the response unit 3. The interrogation unit 2 and the response unit 3 are so arranged at the respective door panels 32' and 32" that on closing of the shaft door 32 they come into such proximity that they can interact in the sense of this invention, i.e. the above-mentioned electromagnetic coupling can take place between them. The interrogation units 2 and the response units 3 are preferably disposed on those parts of the respective door panels that overlap when the door is closed. The interrogation units 2 and the response units 3 are preferably so arranged at the corresponding door panels 32' and 32" that they first interact in the sense of the invention when the door panels 32' and 32" are already mechanically or electromechanically locked. The interrogation units 2 of each shaft door 32 are serially connected by way of the bus line 13 with one another and with the checking unit 12. The interrogation of the interrogation units 2, the response of the response units 3 and the data transmission to the checking unit 12 functions exactly as is illustrated in FIG. 3. With the assistance of this safety chain S operating in the manner according to the invention the door contacts of the shaft doors can be securely monitored and unambiguously identified. False triggerings are avoided. The checking unit 12 constantly checks the state of the door contacts and is connected in a conventional manner with a central elevator control, which is not shown.

The same principle can also be used for the car doors of the elevator.

The monitoring device according to the present invention can be used at all locations of an elevator which are to be made safe, and the switching devices can replace all safety switches of an elevator.

The active and/or the passive unit can also be provided with switch contacts or with semiconductor switches, which, for example, put the energy store or the antenna out of operation. This could be used, for example, with existing mechanical contacts.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. A monitoring device for an elevator comprising:

at least two contactlessly actuatable switching devices, each said switching device including an active unit and a passive unit wherein said active unit generates a predetermined pattern as a bit pattern or a bit sequence and said passive unit is excited exclusively by said predetermined pattern, said passive unit being excited by said predetermined pattern at a defined spacing between said active unit and said passive unit; and a bus connecting a central checking unit with said at least two switching devices in a safety chain for the elevator.

2. The monitoring device according to claim 1 wherein said at least two switching devices and said central checking unit are connected in series.

3. The monitoring device according to claim 1 wherein each said active unit includes a first coil for transmitting said predetermined pattern and each said passive unit includes a second coil for receiving said predetermined pattern.

4. The monitoring device according to claim 1 wherein each said passive unit includes an energy store for storing energy from said predetermined pattern.

5. The monitoring device according claim 1 wherein said predetermined pattern is a number represented by said bit pattern or said bit sequence.

6. The monitoring device according to claim 1 including an elevator door associated with each said switching device, each said elevator door having a first door panel and a second door panel and wherein said active unit is arranged at said first door panel and said passive unit is arranged at said second door panel.

7. The monitoring device according to claim 6 wherein each said elevator door is one of a shaft door and a car door.

8. The monitoring device according to claim 1 wherein each said active unit is constructed as a transceiver and each said passive unit is a transponder.

9. A method of monitoring a safety chain of an elevator comprising the steps of:

a. providing a plurality of switching devices and a central checking unit connected in a safety chain for an elevator, each of the switching devices having an active unit and a passive unit associated with one another;

b. generating a pattern from each of the active units;

c. receiving the pattern from each of the active units with the associated one of the passive units when the associated passive unit is at a defined spacing from the associated active unit;

d. generating a response from the associated passive writ upon receiving the pattern; and e. receiving the response from the associated passive unit with the associated active unit.

10. The method according to claim 9 including not performing said steps d. and e. when the defined spacing between the associated active unit and the associated passive unit is exceeded.

11. The monitoring device according to claim 1 wherein each said active unit is connected to said bus.

12. A monitoring device for an elevator comprising:

at least two contactlessly actuatable switching devices, each said switching device including an active unit and a passive unit wherein said active unit generates a predetermined pattern as a bit pattern or a bit sequence and said passive unit is excited exclusively by said predetermined pattern, said passive unit being excited by said predetermined pattern at a defined spacing between said active unit and said passive unit to generate a response pattern to said active unit and a central checking unit connected with said active units of said at least two switching devices in a safety chain for the elevator for receiving the response patterns.

13. The monitoring device according to claim 11 wherein response patterns are a bit pattern or a bit sequence.

* * * * *